US007211771B1

(12) United States Patent
Smith et al.

(10) Patent No.: US 7,211,771 B1
(45) Date of Patent: May 1, 2007

(54) DE-ICING SYSTEM FOR TRAFFIC SIGNALS

(75) Inventors: David L. Smith, Rowlett, TX (US); Steven M. Canan, Sachse, TX (US)

(73) Assignee: Precision Solar Controls Inc., Garland, TX (US)

( * ) Notice: Subject to any disclaimer, the term of this patent is extended or adjusted under 35 U.S.C. 154(b) by 143 days.

(21) Appl. No.: 11/281,597

(22) Filed: Nov. 18, 2005

(51) Int. Cl.
*H05B 1/02* (2006.01)

(52) U.S. Cl. ..... 219/502; 219/213; 219/497; 219/501; 116/202; 340/581

(58) Field of Classification Search ..... 219/213, 219/497, 501, 502, 507, 508, 487; 116/202; 340/581
See application file for complete search history.

(56) References Cited

U.S. PATENT DOCUMENTS

| | | | | |
|---|---|---|---|---|
| 4,724,304 | A | 2/1988 | Teshima et al. | |
| 4,729,076 | A | 3/1988 | Masami et al. | |
| 5,782,555 | A | 7/1998 | Hochstein | |
| 5,785,418 | A | 7/1998 | Hochstein | |
| 6,045,240 | A | 4/2000 | Hochstein | |
| 6,282,969 | B1 * | 9/2001 | Daniel | 73/866.1 |
| 6,354,714 | B1 | 3/2002 | Rhodes | |
| 6,430,996 | B1 * | 8/2002 | Anderson et al. | 73/170.26 |
| 6,601,983 | B1 * | 8/2003 | Runfola et al. | 362/545 |
| 2003/0002179 | A1 | 1/2003 | Roberts et al. | |
| 2005/0063182 | A1 * | 3/2005 | Birch et al. | 362/249 |

FOREIGN PATENT DOCUMENTS

| | | | |
|---|---|---|---|
| JP | 2003303399 | A | 10/2003 |

* cited by examiner

*Primary Examiner*—Mark Paschall
(74) *Attorney, Agent, or Firm*—Nixon & Vanderhye P.C.

(57) ABSTRACT

A circuit is disclosed for detecting and eliminating the buildup of snow and/or ice on the viewable face of an LED traffic signal lens. The circuit measures the ambient temperature within the LED signal, and when the temperature falls to a level where snow and/or ice accumulation can occur, the circuit begins looking for snow and/or ice buildup on the lens of the LED signal. An infrared LED transmits a signal which is reflected when snow or ice is present on the lens of the traffic signal. When the reflected signal is received by an infrared receiver, it sends a signal to a microcontroller, which analyzes the signal to determine if it is a valid signal. If it is, a heater is turned on until the ice and snow are removed.

32 Claims, 7 Drawing Sheets

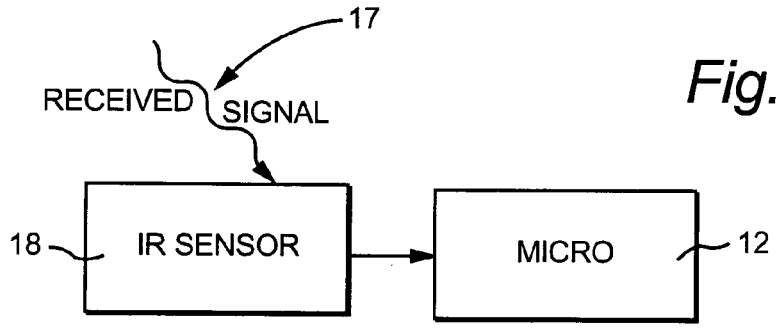
Fig. 5
Fig. 6
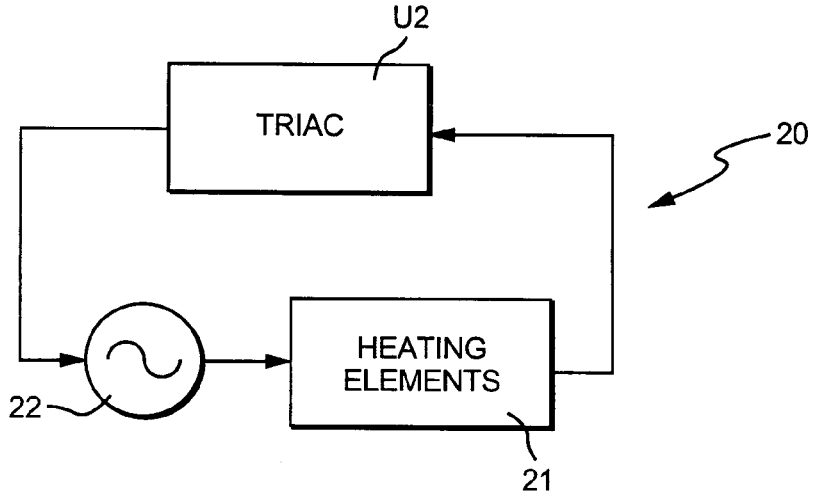
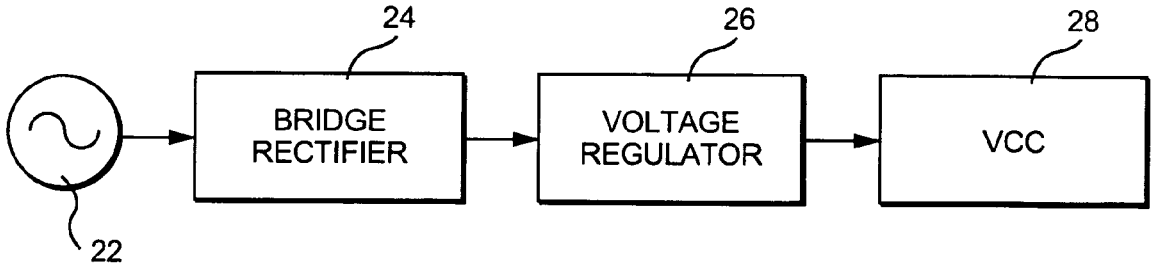
Fig. 8

DE-ICING SYSTEM FOR TRAFFIC SIGNALS

The present invention relates to LED traffic signals, and, more particularly, to a circuit for detecting and eliminating the buildup of snow and ice on the lenses of LED traffic signals.

SUMMARY OF THE INVENTION

Before light emitting diode ("LED") traffic signals began replacing traffic signals using incandescent bulbs, the buildup of frozen matter, such as snow and ice, on the viewable faces or lenses of incandescent traffic signals was not an issue. Typically, the incandescent signals required an amount of power that was much larger than that required by LED traffic signals. The large amount of power used by incandescent traffic signals was converted to heat and dissipated through the face or lens of the traffic signal, resulting in the melting of most, if not all, snow and ice on the lenses of the incandescent traffic signals.

With the introduction of LED traffic signals, a significant reduction in power consumption over that used by incandescent signals was realized. The LEDs used in such signals convert the input power more efficiently and thus dissipate much less heat through the lens of the traffic signal. However, this significant improvement in power efficiency provided by the LED traffic signals eliminated the inherent benefit of the incandescent signals to reduce or eliminate the buildup of frozen snow and/or ice on the lenses of the traffic signals. This dangerous buildup of snow and/or ice on the LED signals has caused many accidents, and is a major concern for the safety of the motoring public.

Thus, it is desirable to provide a circuit that would detect and eliminate the buildup of ice or snow on the lenses of LED traffic signals.

BRIEF DESCRIPTION OF THE INVENTION

The present invention is directed to a circuit that detects and eliminates the buildup of frozen matter, such as snow or ice, on the viewable face or lens of an LED traffic signal. The circuit of the present invention monitors the ambient temperature within the traffic signal, and when the temperature falls below a certain set point where snow and/or ice accumulation can occur, the circuit begins looking for the buildup of snow and/or ice on the lens of the traffic signal. When the circuit detects the buildup of frozen matter, the circuit "warms" the face or lens of the traffic signal so as to defrost, and thereby eliminate, the frozen matter buildup. The circuit of the present invention uses a heating element or a plurality of elements that are mounted on, or in proximity to, the face or lens of the LED traffic signal to warm the face or lens of the signal. The heating elements are activated only when a sensor detects the buildup of frozen matter on the lens of the signal. The heating elements can be any device that produces heat when power is applied to them. Preferably, the heating elements are a plurality of high wattage resistors.

The circuit of the present invention includes a microcontroller that monitors ambient temperature within the LED traffic signal using an internal sensor. If the ambient temperature is above a temperature set point where ice and/or snow can form, the microcontroller takes no action. If the ambient temperature is below the set point, the microcontroller begins looking for the build-up of ice or snow on the lens of the LED traffic signal. Using an internal analog-to-digital converter that receives a signal from a photodiode light sensor, the microcontroller measures the ambient light level external to the signal. The measure of ambient light is used by the microcontroller as a baseline to reduce or eliminate false triggering of the circuits used to detect the buildup of ice or snow due to external light sources, such as sunlight, street lights, etc.

The circuits used to detect the buildup of ice or snow on the lens of an LED signal preferably include an infrared LED as a transmitter. The gain of the transmitter is continuously adjusted by the microcontroller using the ambient light level measurement received from the photodiode light sensor. Using an internal digital-to-analog converter, the microcontroller adjusts the gain of the infrared LED transmitter by adjusting the voltage applied to the base of a transistor that controls the operation of the infrared LED. This adjustment to the gain of the transmitter, in turn, controls the transmitting power of the infrared LED transmitter. Preferably, the microcontroller applies to the base of the transistor a 40 kHz signal modulated at 100 Hz, the signal being generated by the microcontroller.

Preferably, an infrared receiver looks for a signal that is reflected from the lens of the LED traffic signal. The reflected signal occurs when there is a buildup of ice and/or snow on the lens of the signal. When the reflected signal is received by the infrared receiver, it demodulates the transmitted signal and sends a 100 Hz signal to the microcontroller. The signal sent by the receiver is analyzed by the microcontroller to determine if it is a valid reflected signal, or if it is noise from an outside light source. The microcontroller determines if a signal is a valid reflected signal by counting the pulses received. If it is a correct count, +/−5, then the signal is valid. If it is a valid reflected signal, the microcontroller then turns on the heating elements. For this purpose, the microcontroller turns on a triac, which applies AC power to the heating elements from an AC power source. Preferably, the heating elements are a series of high wattage resistors located near or on the lens of the traffic signal. However, it should be noted that other heating elements could be used, such as ceramic elements, resistive wire, resistive coatings, filaments, ultrasonic heaters, microwave signals, and Peltier thermoelectric devices. The heater will continue to heat the signal lens until the temperature measured by the microcontroller rises above a controlled set point, or the snow and ice condition no longer exists.

BRIEF DESCRIPTION OF THE DRAWINGS

FIG. 5 is a simplified block diagram showing the operation of the microcontroller in receiving a signal from the infrared receiver circuit, indicating the presence of snow and/or ice on the lens of the LED traffic signal.

FIG. 6 is a simplified block diagram showing the heater circuit used in the present invention for heating the signal lens to eliminate the buildup of snow and/or ice on the lens.

FIG. 8 is a simplified block diagram showing the voltage rectifying and regulating circuit for generating the power supply voltage for the circuit of the present invention.

DETAILED DESCRIPTION OF THE INVENTION

The present invention is directed to a circuit 10 for detecting the buildup of snow and/or ice on the lens of an LED traffic signal and for eliminating the buildup of the snow and/or ice from the lens of an LED traffic signal.

The heart of circuit 10 is a microcontroller 12, which senses ambient temperature within the LED signal, initiates the function of looking for snow and/or ice buildup when the ambient temperature falls below a certain set point and initiates the operation of a heater to eliminate ice and/or snow when it is detected. Preferably, microcontroller 12 is a CY8C27143B programmable microcontroller manufactured, for example, by Cypress Semiconductor Corp. Microcontroller 12 is shown as component U1 in the schematic of circuit 10 shown in FIG. 1, which includes an internal sensor to monitor the temperature within the LED signal.

Figure 1:
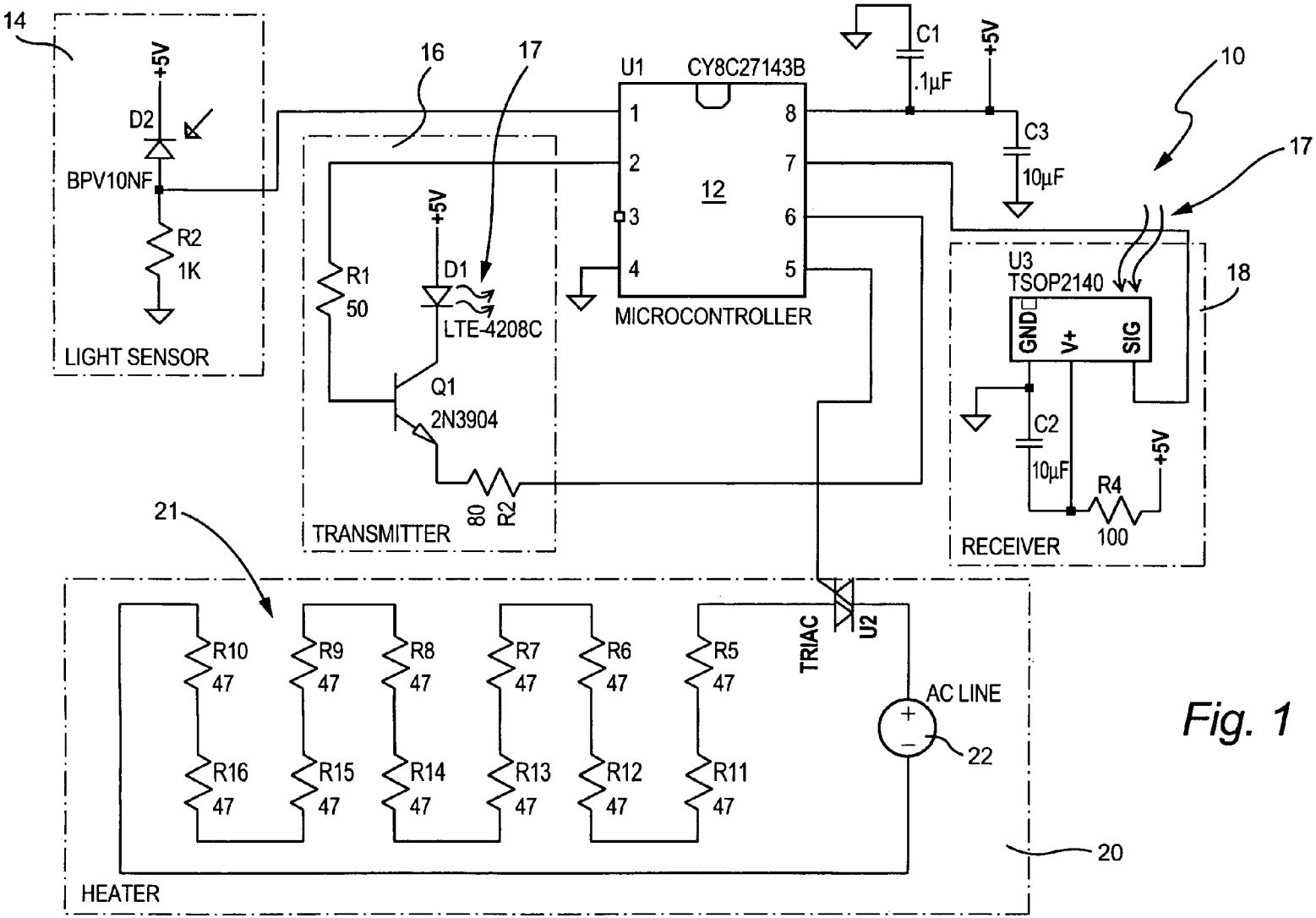
FIG. 1 is a schematic drawing of the circuit of the present invention for detecting and eliminating the buildup of snow and/or ice on the lens of an LED traffic signal.
Figure 2:
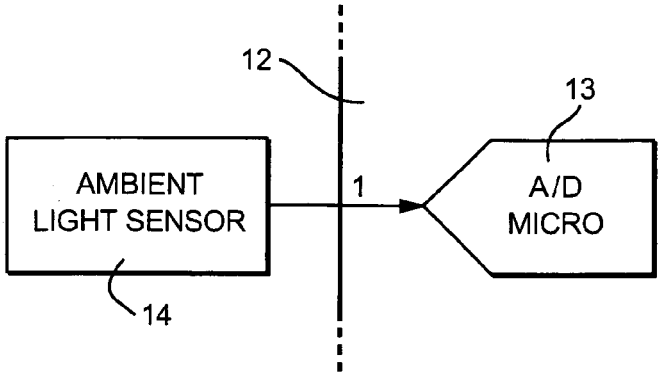
FIG. 2 is a simplified block diagram depicting the operation of the microcontroller in reading the ambient light level from a light sensor, using an analog-to-digital converter.

As shown in FIGS. 1 and 2, the circuit 10 also includes an ambient light sensor circuit 14, which uses a light sensing photodiode D2 to detect the level of ambient light normally entering the lens of the LED traffic signal. Preferably, photodiode D2 is, for example, a BPV10NF Light Sensor manufactured by Vishay. Microcontroller 12 monitors the temperature, using an internal sensor. Microcontroller 12 reads the ambient light level from the light sensor D2 using an analog-to-digital converter 13 that is internal to microcontroller 12. The monitoring of the ambient temperature by microcontroller 12 occurs at one-minute intervals. If the ambient temperature is above a set point where ice and snow can occur, microcontroller 12 takes no action. If the temperature is below the set point, microcontroller 12 will begin looking for a buildup of ice and/or snow.

Using the information obtained from ambient light sensor 14, microcontroller 12 adjusts the gain of an infrared LED transmitter circuit 16 to reduce or eliminate false triggering due to external light sources, such as sunlight and streetlights. The information received by microcontroller 12 from ambient light sensor 14 is used as a baseline by microcontroller 12 to reduce or eliminate false triggering due to the external light sources.

Figure 4:
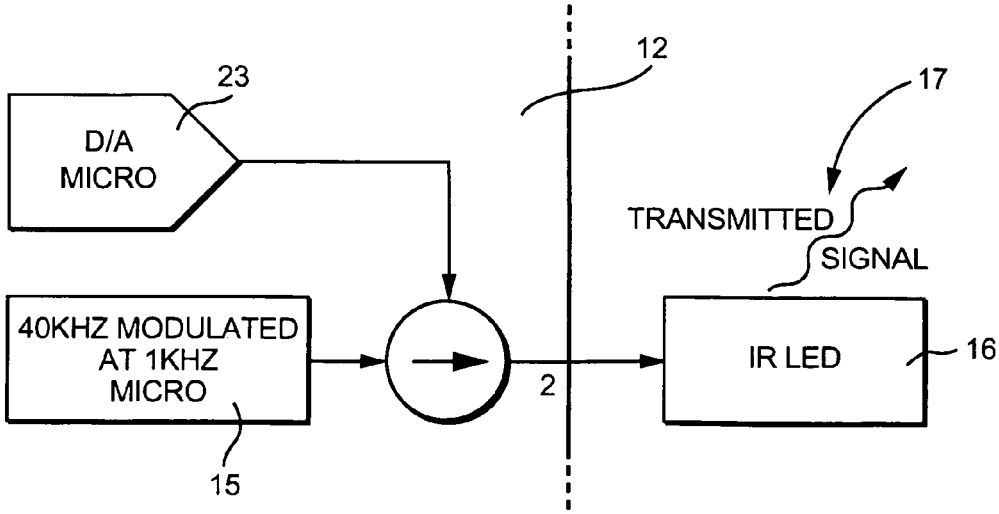
FIG. 4 is a simplified block diagram, showing the operation of the microcontroller in adjusting the transmitter power of the infrared LED transmitter.

Infrared LED transmitter circuit 16 includes an infrared light emitting diode D1, which functions as a transmitter. Preferably, diode D1 is an LTE-4208C Infra-red LED Emitter manufactured, for example, by Lite-On Technology Corporation. Microcontroller 12 adjusts the voltage on the base of a transistor Q1, which controls the forward bias of infrared LED D1, as transistor Q1 is turned on. Transistor Q1 is preferably a 2N3904 PNP transistor. As shown in FIG. 4, microcontroller 12 adjusts the voltage it applies to the base of transistor Q1 using a digital-to-analog converter 23 that is internal to microcontroller 12. By controlling the voltage applied to the base of transistor Q1, microcontroller 12 controls the power of transmitter circuit 16. As also shown in FIG. 4, microcontroller 12 performs this function using a 40 kHz signal modulated at 100 Hz. This signal is generated by the microcontroller 12 and applied to the infrared LED D1 through the emitter of transistor Q1. A 40 Khz signal modulated at 100 Hz is used for the transmitting function because the infrared receiver is tuned to 40 Khz. A 40 Hhz signal burst is modulated at 100 Hz to give the receiver time between bursts to reset itself. The benefit is noise immunity and lower susceptibility to the effects of ambient light.

Figure 3:
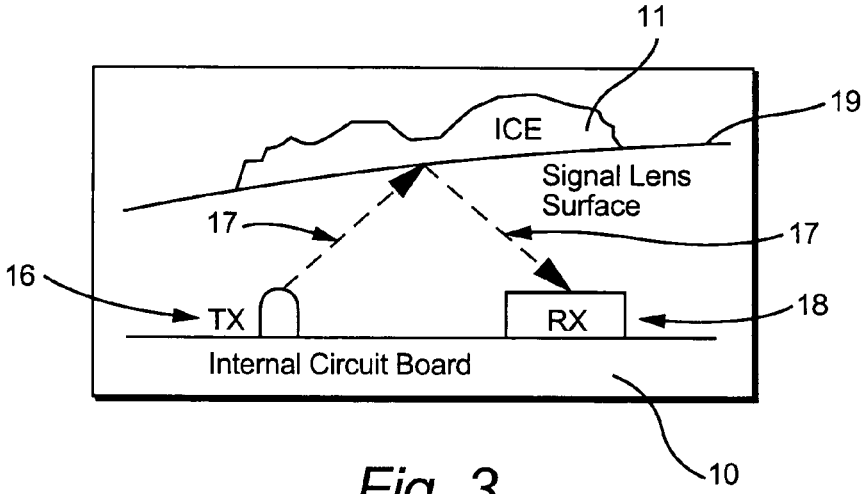
FIG. 3 is a side elevational view showing the operation of the infrared LED transmitter and the infrared LED receiver, in which a reflected signal is detected that indicates the presence of snow and/or ice on the lens of an LED traffic signal.

As shown in FIG. 3, transmitter circuit 16 transmits an infrared signal 17, which is directed towards the lens 19 of the LED traffic signal. When the signal 17 reaches the surface of signal lens 19, if there is no buildup of ice or snow on lens 19, signal 17 will migrate through lens 19 to the exterior of the LED traffic signal. Conversely, when signal 17 reaches the surface of lens 19, if there is a buildup of ice and/or snow 11 on lens 19, signal 17 is reflected back into the interior of the LED traffic signal, where it is received by receiver circuit 18. Receiver circuit 18 includes an infrared receiver U3, which is preferably a model TSOP2140 integrated circuit manufactured by Vishay. When reflected signal 17 is received by receiver circuit 18, it demodulates reflected signal 17, and sends a 100 Hz signal to microcontroller 12, as shown in FIG. 5. The 100 Hz signal received by microcontroller 12 is then analyzed by microcontroller 12 to determine if it is a valid reflected signal or noise from an external light source. If received signal 17 is a valid signal, then microcontroller 12 will turn on heater circuit 20 shown in FIGS. 1 and 6.

Microcontroller 12 turns on heater circuit 20 by turning on a triac U2, which applies AC power from an AC power source 22 to heating elements 21. Preferably, heating elements 21 are a plurality of high wattage resistors R5–R16 connected in series between triac U2 and the AC power source 22. Although it should be noted, however, that other heating elements could be used, such as ceramic elements, resistive wire, resistive coatings, filaments, ultrasonic heaters, microwave signals, and Peltier thermoelectric devices. Regardless of the type of heating element used, microcontroller 12 would turn on triac U2 to apply a voltage that turns on heater circuit 20. Thus, for example, if heater circuit 20 were an ultrasonic heater, heater circuit 20 would be comprised of an ultrasonic emitter with its associated drive circuitry powered by triac U2 under the control microcontroller 12.

Heater circuit 20 continues to heat signal lens 19 until the temperature measured by microcontroller 12 through its internal sensor rises above the temperature set point, or the snow and/or ice condition on lens 19 no longer exists. In the latter case, signal 17 transmitted by transmitter circuit 16 is no longer reflected by snow and/or ice on lens 19 so as to be received by receiver circuit 18.

FIGS. 7*a* through 7*h* are plan and side elevational drawings showing alternative heating elements 21 that can be used in heater circuit 20 and locations of such heating elements 21 relative to the lens 19 of an LED traffic signal 30.

Figure 7A:
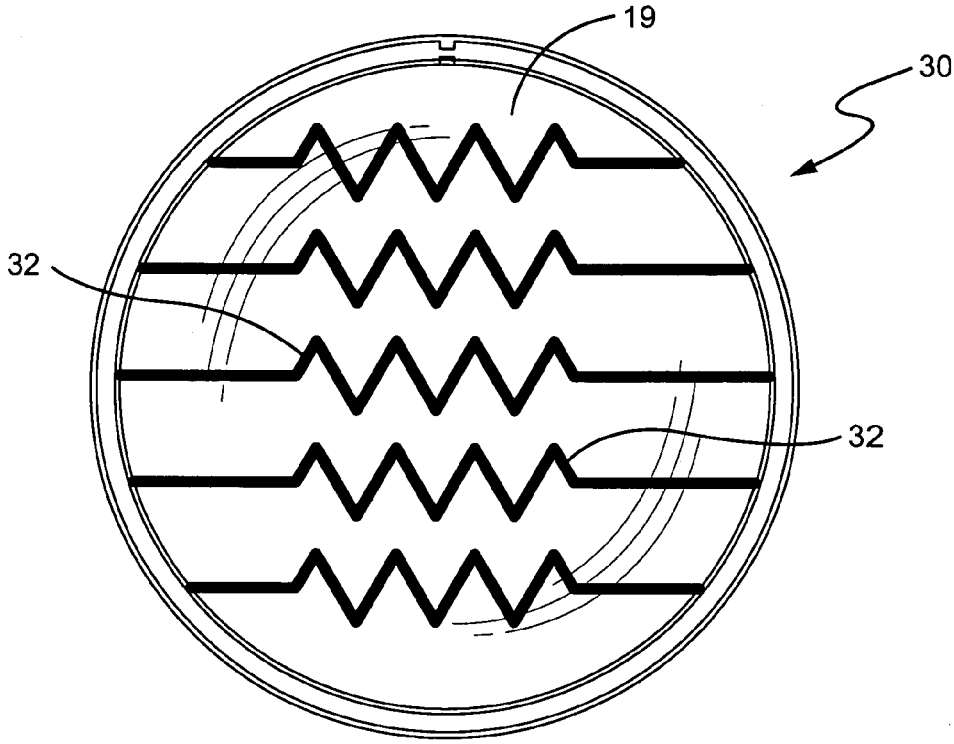
FIGS. 7A through 7*h* are plan and side elevational drawings showing alternative heating elements that can be used and locations of such heating elements relative to the lens of an LED traffic signal.
Figure 7B:
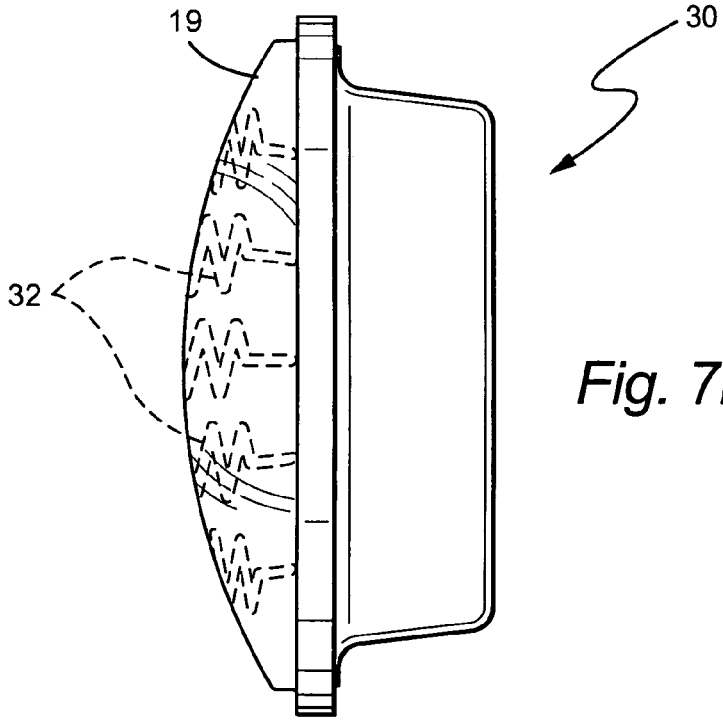

FIGS. 7*a* and 7*b* are plan and side elevational drawings, respectively, of an LED traffic signal 30 including heating elements 21 in the form of a plurality of resistive coatings 32 located on the lens 19 of traffic signal 30 and positioned in multiple iterations of a back and forth pattern across lens 19 to heat lens 19. Preferably, resistive coatings 32 are connected in series between triac U2 and the AC power source 22.

Figure 7C:
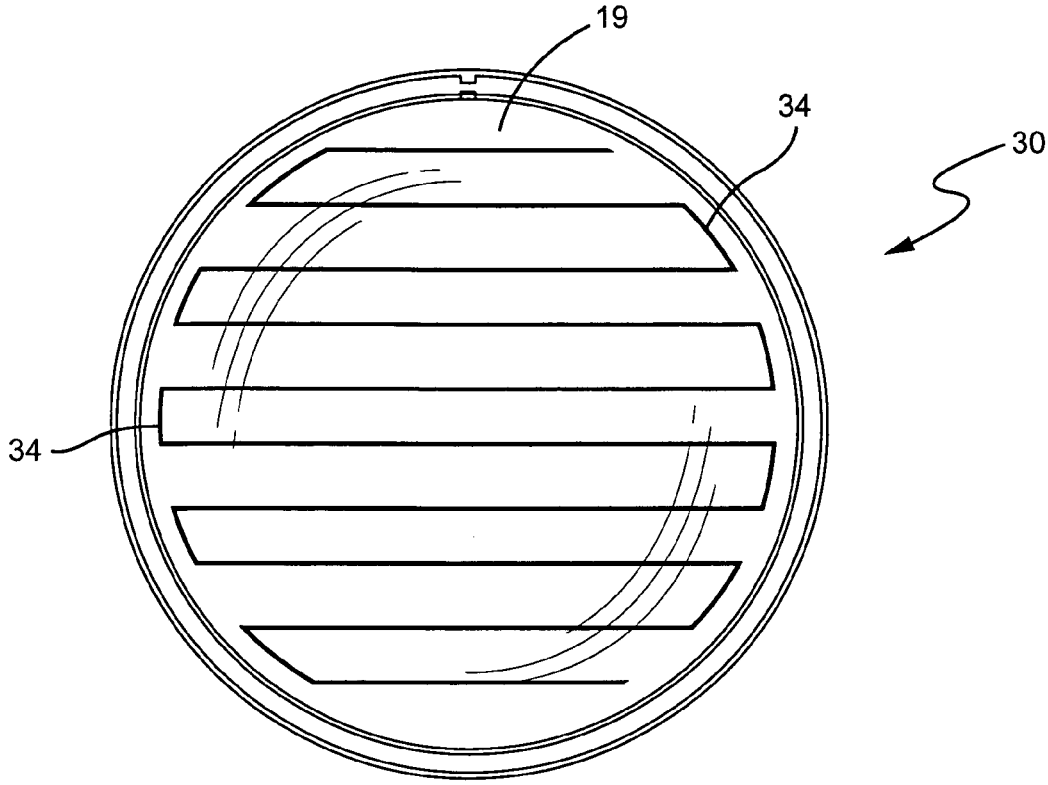
Figure 7D:
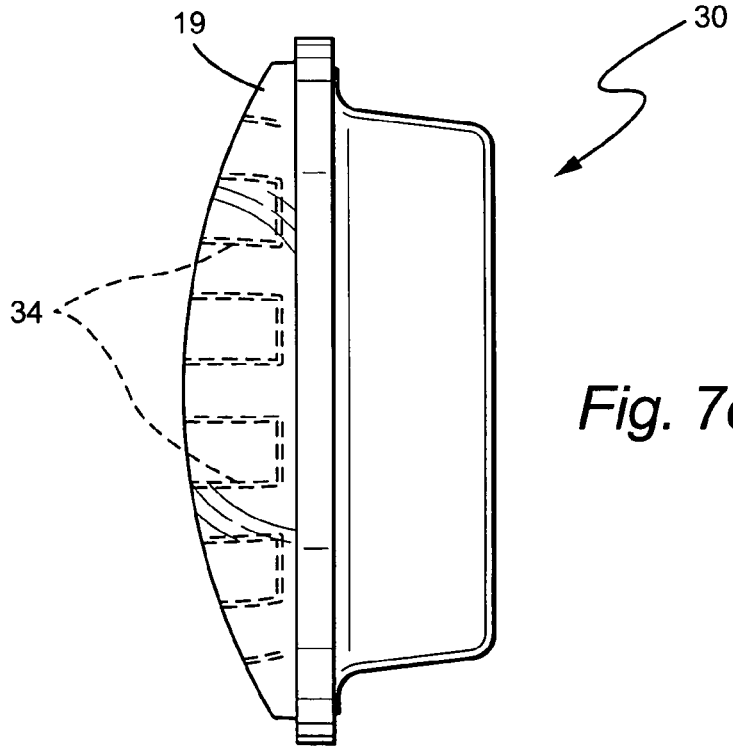

FIGS. 7*c* and 7*d* are plan and side elevational drawings, respectively, of LED traffic signal 30 including heating elements 21 in the form of a resistive wire 34 located on the lens 19 of the traffic signal 30 and positioned in multiple iterations of a back and forth pattern across lens 19 to heat lens 19. Preferably, resistive wire 34 is connected between triac U2 and the AC power source 22.

Figure 7E:
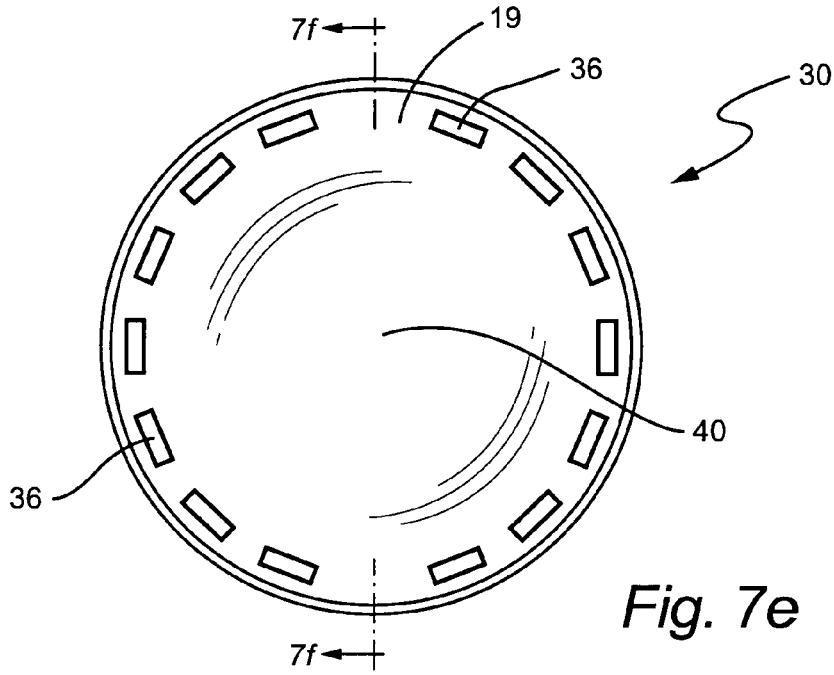
Figure 7G:
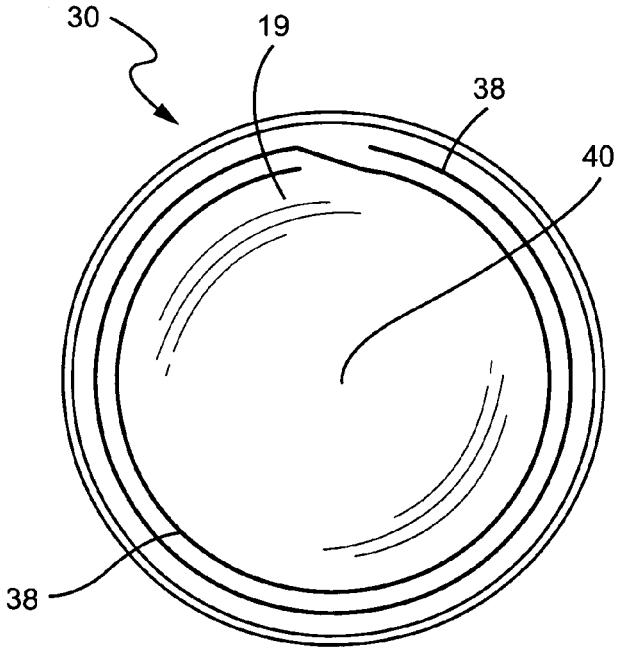
Figure 7H:
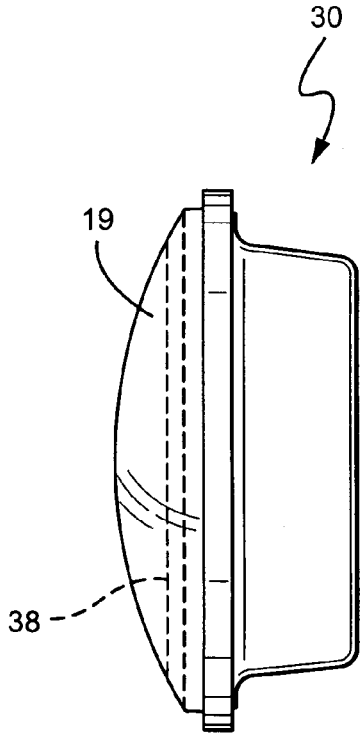
Figure 7F:
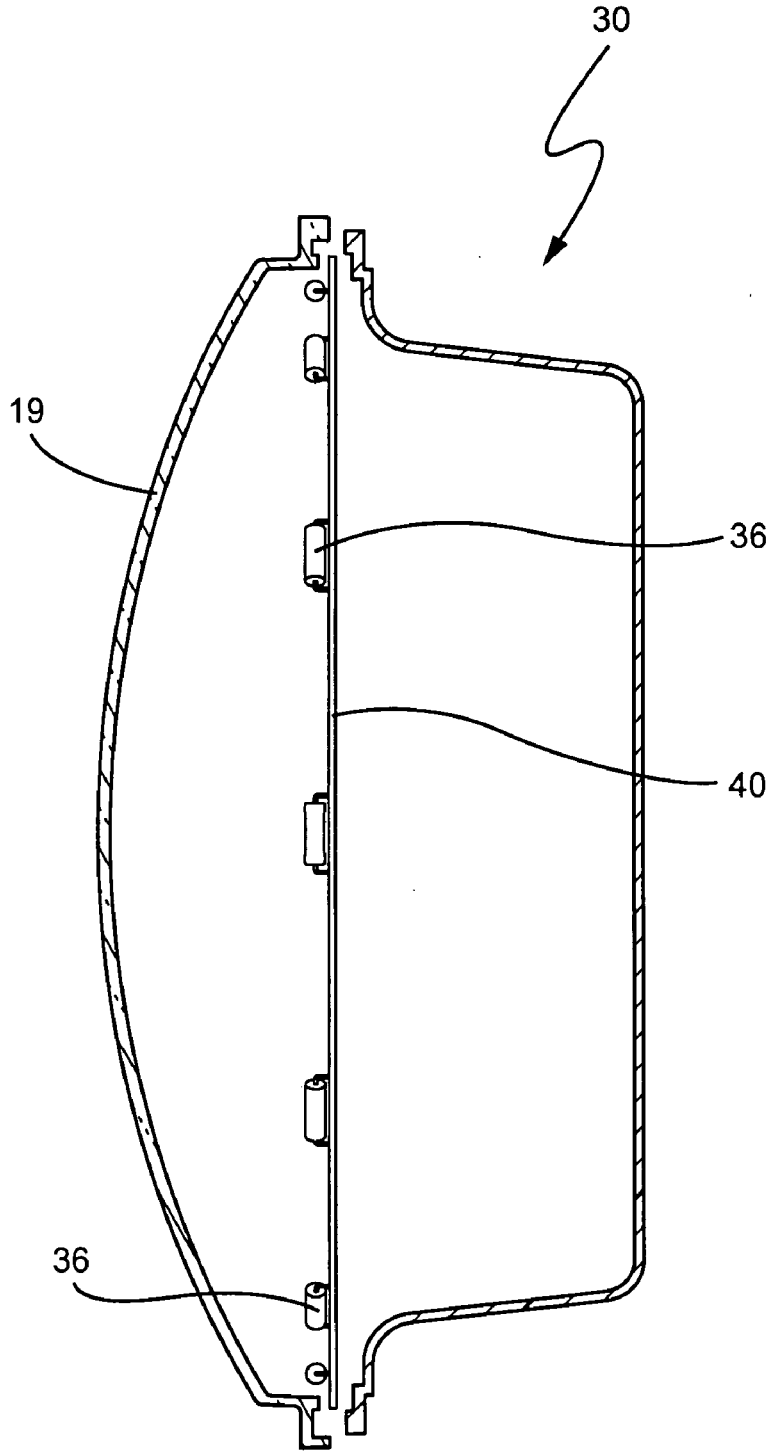

FIGS. 7*e* and 7*f* are plan and side elevational drawings, respectively, of LED traffic signal 30 including heating elements 21 in the form of a plurality of resistors 36, shown as resistors R5 through R16 in the schematic of FIG. 1, and located substantially at the periphery of the circuit board 40 on which are mounted an array of light emitting diodes (not shown) used to provide the particular color light emitted by LED traffic signal 30 so as to be in close proximity to lens 19 to heat lens 19. Preferably, resistors 36 are connected in series between triac U2 and the AC power source 22.

FIGS. 7*g* and 7*h* are plan and side elevational drawings, respectively, of LED traffic signal 30 including heating elements 21 in the form of a resistive wire 38 located on the lens 19 of the traffic signal 30 and positioned, to heat lens 19, in a multi-loop circular pattern on lens 19 where such lens is in close proximity to the circuit board 40 on which the array of light emitting diodes are mounted. Preferably, resistive wire 38 is connected between triac U2 and the AC power source 22.

The power supply used by circuit 10 for its operation supplies a voltage of VCC, which is typically 5V DC. As shown in FIG. 8, AC voltage supplied by AC power supply 22 is fed into a bridge rectifier 24, which rectifies the AC voltage signal and then feeds it to a voltage regulator 26 to then produce the DC supply voltage 28 labeled as VCC.

The circuit 10 of the present invention for detecting and eliminating the buildup of ice and/or snow from the lens of an LED traffic signal can be used with a single array of LEDs that form one of the signal lights of a traffic signal, such as the red, amber and green signals that are typically included in traffic signals. The circuit 10 can also be used with multiple arrays of LEDs that form the red, amber and green signals included in traffic signals. In the latter instance, it would be necessary to have an ambient light sensor circuit 14, a transmitter circuit 16, a receiver circuit 18, and a heater circuit 20 for each of the LED arrays; however, a single microcontroller 12 could be used to interact with and control these circuits in each of the LED arrays.

While the invention has been described in connection with what is presently considered to be the preferred embodiment, it is to be understood that the invention is not to be limited to the disclosed embodiment, but on the contrary, is intended to cover various modifications and equivalent arrangements included within the spirit and scope of the appended claims.

What is claimed is:

1. A circuit for detecting and eliminating a buildup of frozen matter on a lens of an LED signal, the circuit comprising:

a first circuit for measuring ambient temperature within the LED signal, a second circuit for transmitting a signal when the ambient temperature is below a predetermined level, a third circuit for receiving a reflection of the transmitted signal when frozen matter is present on the lens of the LED signal, and a fourth circuit for heating the lens of the LED signal until the ambient temperature rises above the predetermined level or the frozen matter on the lens of the LED signal is eliminated.

2. The circuit of claim 1, wherein the first circuit is a microcontroller that includes an internal temperature sensor and that controls the operation of the second circuit based on the level of the ambient temperature and of the fourth circuit based on the third circuit receiving a reflection of the transmitted signal.

3. The circuit of claim 2 further comprising a fifth circuit for measuring ambient light entering through the lens of the LED signal, the microcontroller using the measure of ambient light as a baseline to reduce or eliminate false triggering of the third signal receiving circuit due to a receipt of light from an external light source.

4. The circuit of claim 3, wherein the fifth ambient light sensing circuit includes a light sensing diode to measure the ambient light, and wherein the microcontroller reads the measured ambient light level using an internal analog-to-digital converter.

5. The circuit of claim 2, wherein the second transmitting circuit includes an infrared LED that functions as a transmitter.

6. The circuit of claim 5, wherein the microcontroller adjusts the second transmitting circuit's gain by controlling a voltage on a base of a transistor used to forward bias the infrared LED.

7. The circuit of claim 2, wherein the microcontroller generates a 40 kHz signal modulated at 100 Hz that is transmitted by the second transmitting circuit.

8. The circuit of claim 2, wherein the third receiving circuit includes an integrated circuit that is an infrared receiver for receiving the reflection of the transmitted signal.

9. The circuit of claim 8, wherein the signal received by the third receiving circuit sends a demodulated signal generated from the reflection of the transmitted signal to the microcontroller when the third receiving circuit receives the reflection of the transmitted signal, and wherein the microcontroller analyzes the demodulated signal to determine if the third receiving circuit received a valid reflection of the transmitted signal or a noise signal from an external light source.

10. The circuit of claim 9, wherein the microcontroller turns on the heater circuit if the reflected transmitted signal is valid.

11. The circuit of claim 1, wherein the heater circuit includes a plurality of heating elements and a solid state switch for applying AC power to the plurality of heating elements.

12. The circuit of claim 11, wherein the plurality of heating elements are connected in series between the solid state switch and an AC power source.

13. The circuit of claim 11, wherein the solid state switch is a triac.

14. The circuit of claim 2, wherein the microcontroller keeps the heating circuit on to melt frozen matter built up on the lens of the LED signal until the ambient temperature rises above the predetermined temperature level or the frozen matter on the LED signal lens is eliminated.

15. The circuit of claim 11, wherein the plurality of heating elements are a plurality resistive coatings positioned in multiple iterations of a back and forth pattern on and across the lens to heat the lens.

16. The circuit of claim 11, wherein the plurality of heating elements are a resistive wire positioned in multiple iterations of a back and forth pattern on and across the lens to heat the lens.

17. The circuit of claim 11, wherein the plurality of heating elements are a plurality of resistors located substantially at a periphery of a circuit board on which are mounted an array of light emitting diodes of the LED signal.

18. The circuit of claim 11, wherein the plurality of heating elements are a resistive wire positioned in multiple loops at substantially a periphery of the lens to heat the lens.

19. A circuit for detecting and eliminating a buildup of snow and/or ice on a lens of an LED traffic signal, the circuit comprising:

a microcontroller for monitoring ambient temperature within the signal, a circuit for measuring ambient light entering through the lens of the LED signal, the ambient light measuring circuit feeding the measure of ambient light to the microcontroller, a transmitter circuit for transmitting an infrared signal when the ambient temperature is below a predetermined set point, the operation of the transmitter circuit being controlled by the microcontroller, a receiver circuit for receiving a reflection of the infrared signal when frozen matter is present on the lens to the LED signal, the receiver circuit feeding the infrared signal to the microcontroller, and a heater circuit for heating the LED signal lens until the ambient temperature measured by the microcontroller rises above the predetermined set point or the buildup of snow and/or ice on the LED signal lens is eliminated.

20. The circuit of claim 19, wherein the microcontroller includes an internal temperature sensor and controls the operation of the transmitter circuit based on the level of the ambient temperature and of the heating circuit based on the receiver circuit receiving a reflection of the transmitted infrared signal.

21. The circuit of claim 19, wherein the ambient light measuring circuit includes a light sensing photodiode, and wherein the microcontroller uses the ambient light level measured by the light sensing photodiode as a baseline to reduce or eliminate false triggering of the receiver circuit due to external light sources.

22. The circuit of claim 19, wherein the transmitter circuit includes an infrared LED that functions as a transmitter, and wherein the microcontroller adjusts the transmitter circuit's gain by controlling a voltage on a base of a transistor used to forward bias the infrared LED.

23. The circuit of claim 19, wherein the receiver circuit includes an integrated circuit that is an infrared receiver for receiving a reflection of the transmitted signal as a result of the LED signal lens being covered by a buildup of snow and/or ice on the lens.

24. The circuit of claim 19, wherein the heater circuit includes a plurality of heating elements connected to an AC power supply, and wherein the microcontroller turns on the heater circuit if the signal received by the receiver circuit is a valid reflected infrared signal.

25. The circuit of claim 24, wherein the plurality of heating elements are located in close proximity to the LED signal lens.

26. The circuit of claim 24, wherein the plurality of heating elements are located on the LED signal lens.

27. The circuit of claim 24, wherein the microcontroller keeps the heater circuit on to melt snow and/or ice built up on the lens of the LED signal until the ambient temperature rises above the predetermined set point or the snow and/or ice on the LED signal lens is eliminated.

28. The circuit of claim 24, wherein the plurality of heating elements are a plurality resistive coatings positioned in multiple iterations of a back and forth pattern on and across the LED signal lens to heat the lens.

29. The circuit of claim 24, wherein the plurality of heating elements are a resistive wire positioned in multiple iterations of a back and forth pattern on and across the LED signal lens to heat the lens.

30. The circuit of claim 24, wherein the plurality of heating elements are a plurality of resistors located substantially at a periphery of a circuit board on which are mounted an array of light emitting diodes of the LED signal so as to be in close proximity to the LED signal lens to heat the lens.

31. The circuit of claim 24, wherein the plurality of heating elements are a resistive wire positioned in multiple loops at substantially a periphery of the LED signal lens to heat the lens.

32. A circuit for detecting and eliminating a buildup of frozen matter on a lens of an LED signal, the circuit comprising:

control means for measuring ambient temperature within the LED signal, means for transmitting a signal when the ambient temperature is below a predetermined level, the control means controlling the operation of the transmitting means based on the level of the ambient temperature, means for receiving a reflection of the transmitted signal when frozen matter is present on the lens of the LED signal, means for measuring ambient light entering through the lens of the LED signal, the control means using the measure of ambient light as a baseline to reduce or eliminate false triggering of the receiving means due to a receipt of light from an external light source, and means for heating the lens of the LED signal until the ambient temperature rises above the predetermined level or the frozen matter on the lens of the LED signal is eliminated, the control means controlling the operation of the heating means based on the receiving means receiving a reflection of the transmitted signal.

* * * * *